US009011188B2

(12) United States Patent
Aoki et al.

(10) Patent No.: US 9,011,188 B2
(45) Date of Patent: Apr. 21, 2015

(54) CONNECTION STRUCTURE OF TERMINAL TO ELECTRIC WIRE

(75) Inventors: Hiroshi Aoki, Toyota (JP); Naoki Kobayashi, Toyota (JP)

(73) Assignee: Yazaki Corporation, Tokyo (JP)

( * ) Notice: Subject to any disclaimer, the term of this patent is extended or adjusted under 35 U.S.C. 154(b) by 157 days.

(21) Appl. No.: 13/583,143

(22) PCT Filed: Mar. 23, 2011

(86) PCT No.: PCT/JP2011/056966

§ 371 (c)(1),
(2), (4) Date: Sep. 6, 2012

(87) PCT Pub. No.: WO2011/118623

PCT Pub. Date: Sep. 29, 2011

(65) Prior Publication Data

US 2012/0329318 A1 Dec. 27, 2012

(30) Foreign Application Priority Data

Mar. 23, 2010 (JP) ..... 2010-066854

(51) Int. Cl.
*H01R 4/02* (2006.01)
*H01R 43/02* (2006.01)
(Continued)

(52) U.S. Cl.
CPC ..... *H01R 4/02* (2013.01); *H01R 4/023* (2013.01); *H01R 43/0207* (2013.01); *H01R 4/723* (2013.01); *H01R 12/57* (2013.01)
USPC ..... 439/874

(58) Field of Classification Search
CPC ..... H01R 4/02; H01R 43/0207; H01R 4/723; H01R 12/57; H01R 4/023
USPC ..... 439/874, 521
See application file for complete search history.

(56) References Cited

U.S. PATENT DOCUMENTS 1,977,846 A * 10/1934 Febrey ..... 403/189
2,379,567 A * 7/1945 Buchanan ..... 439/868
(Continued)

FOREIGN PATENT DOCUMENTS

JP 10-12290 A 1/1998
JP 2004-207172 A 7/2004
JP 2007-12329 A 1/2007

OTHER PUBLICATIONS

International Search Report (PCT/ISA/210), issued by the International Searching Authority in corresponding International Application No. PCT/JP2011/056966 on May 17, 2011.
(Continued)

*Primary Examiner* — Amy Cohen Johnson
*Assistant Examiner* — Vladimir Imas
(74) *Attorney, Agent, or Firm* — Sughrue Mion, PLLC

(57) ABSTRACT

In a connection structure of a terminal (10), a distal end of the electric wire (W) is inserted into the electric wire connection part (12) of the terminal (10) and a conductor (Wa) and a portion of an insulating sheath (Wb) of the electric wire (W) are placed on an upper surface of the base plate parts (21, 23) and the conductor (Wa) is bonded to the base plate parts (21, 23) by welding in that state, a portion of at least the conductor (Wa) of the distal end of the electric wire (W) inserted into the electric wire connection part (12) is covered with a metallic cover member (30) and the conductor (Wa) is bonded to the base plate parts (21, 23) together with the cover member (30) by welding.

3 Claims, 4 Drawing Sheets

(51) Int. Cl.
*H01R 4/72* (2006.01)
*H01R 12/57* (2011.01)

(56) References Cited

U.S. PATENT DOCUMENTS

| | | | | | |
|---|---|---|---|---|---|
| 2,664,844 | A * | 1/1954 | Bruno et al. | 228/56.3 |
| 2,815,497 | A * | 12/1957 | Redslob | 439/203 |
| 3,656,092 | A * | 4/1972 | Swengel et al. | 439/730 |
| 3,838,387 | A * | 9/1974 | Grillet | 174/71 R |
| 4,491,381 | A * | 1/1985 | Hamsher et al. | 439/465 |
| 4,496,206 | A * | 1/1985 | Markwardt et al. | 439/409 |
| 4,602,831 | A * | 7/1986 | Lockard | 439/108 |
| 4,824,383 | A * | 4/1989 | Lemke | 439/108 |
| 4,889,503 | A * | 12/1989 | Philippson et al. | 439/607.45 |
| 4,927,375 | A * | 5/1990 | Debortoli et al. | 439/357 |
| 5,030,138 | A * | 7/1991 | Capp et al. | 439/497 |
| 5,171,166 | A * | 12/1992 | Sato et al. | 439/578 |
| 5,300,755 | A * | 4/1994 | Nishitani et al. | 219/121.63 |
| 5,499,448 | A * | 3/1996 | Tournier et al. | 29/863 |
| 5,569,882 | A * | 10/1996 | Yokoyama et al. | 174/76 |
| 5,662,493 | A * | 9/1997 | Reichle | 439/409 |
| 5,713,745 | A * | 2/1998 | Sakurai et al. | 439/78 |
| 5,749,756 | A * | 5/1998 | Vockroth et al. | 439/879 |
| 5,857,259 | A * | 1/1999 | Johnston | 29/858 |
| 6,102,728 | A * | 8/2000 | Shinchi | 439/397 |
| 6,142,838 | A * | 11/2000 | Shinchi | 439/874 |
| 6,171,150 | B1 * | 1/2001 | Saito et al. | 439/607.51 |
| 6,247,977 | B1 * | 6/2001 | Tanaka et al. | 439/874 |
| 6,249,966 | B1 * | 6/2001 | Pereira et al. | 29/882 |
| 6,319,046 | B1 * | 11/2001 | Feye-Hohmann et al. | 439/395 |
| 6,939,164 | B2 * | 9/2005 | Noro | 439/492 |
| 7,014,496 | B2 * | 3/2006 | Shimirak | 439/409 |
| 7,018,230 | B2 * | 3/2006 | Shimirak | 439/409 |
| 7,033,233 | B2 * | 4/2006 | Fujimoto et al. | 439/874 |
| 7,048,562 | B2 * | 5/2006 | Lutsch et al. | 439/275 |
| 7,084,346 | B2 * | 8/2006 | Pabst | 174/74 R |
| 7,124,501 | B2 * | 10/2006 | Bender | 29/840 |
| 7,303,426 | B2 * | 12/2007 | Shimirak | 439/409 |
| 7,374,466 | B2 * | 5/2008 | Onuma et al. | 439/874 |
| 7,413,488 | B2 * | 8/2008 | Matsumura | 439/874 |
| 7,658,654 | B2 * | 2/2010 | Ohyama et al. | 439/752 |
| 7,705,265 | B2 * | 4/2010 | Asakura et al. | 219/121.64 |
| 7,722,394 | B2 * | 5/2010 | Feldman et al. | 439/578 |
| 7,828,585 | B2 * | 11/2010 | Kurimoto | 439/468 |
| 8,043,114 | B2 * | 10/2011 | Kaneko et al. | 439/497 |
| 8,267,714 | B2 * | 9/2012 | Siemon et al. | 439/404 |
| 8,475,210 | B2 * | 7/2013 | Wang et al. | 439/607.31 |
| 8,512,069 | B2 * | 8/2013 | Kao et al. | 439/465 |
| 8,622,775 | B2 * | 1/2014 | Takashima et al. | 439/886 |
| 8,627,996 | B2 * | 1/2014 | Patrikios | 228/110.1 |
| 2002/0096352 | A1 * | 7/2002 | Kuwayama et al. | 174/74 R |
| 2006/0091994 | A1 * | 5/2006 | Nelson | 338/195 |
| 2009/0218134 | A1 * | 9/2009 | Stroh et al. | 174/74 R |
| 2009/0229880 | A1 * | 9/2009 | Watanabe | 174/72 A |
| 2010/0003867 | A1 * | 1/2010 | Lehmann et al. | 439/874 |

OTHER PUBLICATIONS

Written Opinion (PCT/ISA/237) of the International Searching Authority, issued in corresponding International Application No. PCT/JP2011/056966 on May 17, 2011.

Communication from the Japanese Patent Office dated Feb. 4, 2014, in a counterpart Japanese application No. 2010-066854.

Office Action, dated Jul. 7, 2014, issued by the State Intellectual Property Office of the People's Republic of China, in counterpart Chinese Patent Application No. 201180015581.0 y.

* cited by examiner

CONNECTION STRUCTURE OF TERMINAL TO ELECTRIC WIRE

TECHNICAL FIELD

The present invention relates to a connection structure of a terminal to an electric wire.

BACKGROUND ART

FIG. 6 shows a connection structure between a terminal and an electric wire described in Patent Reference 1.

This terminal 110 has an electrical connection part 111 connected to a battery etc. in the front, and also has an electric wire connection part 112 connected to the distal end of an electric wire W by ultrasonic welding in the back of the electrical connection part 111. The electric wire connection part 112 includes a conductor connection part 114 positioned in the front side, and a sheath fixing part 115 positioned in the back side of the conductor connection part 114, and the conductor connection part 114 is formed in a U-shaped cross section by having a base plate part 121, and a pair of side wall parts 122, 122 upwardly erected from both lateral edges of the base plate part 121. The distal end of the electric wire W is electrically and mechanically connected to the terminal 110 by placing a conductor Wa exposed by removing an insulating sheath Wb on the base plate part 121 of the conductor connection part 114 and holding the portion covered with the insulating sheath Wb in the sheath fixing part 115 and welding the conductor Wa to the base plate part 121 of the conductor connection part 114 in that state.

PRIOR ART REFERENCE

Patent Reference

Patent Reference 1: JP-A-2007-12329

DISCLOSURE OF THE INVENTION

Problems that the Invention is to Solve

Incidentally, in the conventional connection structure between the terminal and the electric wire described above, the conductor Wa of the distal end of the electric wire W connected to the terminal 110 remains exposed to the outside, so that when water adheres to the conductor Wa, the conductor Wa is susceptible to corrosion, with the result that there was fear of damaging electrical connection reliability.

The invention has been implemented in view of the circumstances described above, and an object of the invention is to provide a connection structure of a terminal to an electric wire constructed so that even when water adheres to an electric wire connection part, the water is prevented from entering a conductor of the electric wire to prevent a problem of corrosion of the conductor of the electric wire and fear of damaging electrical connection reliability can be solved.

Means for Solving the Problems

In order to achieve the object described above, a connection structure of a terminal to an electric wire according to the invention is characterized by the following (1) to (4).

(1) A connection structure of a terminal to an electric wire constructed so that a terminal having an electrical connection part for making connection to the other terminal in the front, and an electric wire connection part formed in substantially a U shape in cross-section view by having a base plate part and a pair of side wall parts upwardly extending from both lateral edges of the base plate part in the back of the electrical connection part is used and a distal end of an electric wire is inserted into the electric wire connection part of the terminal and a conductor exposed by removing an insulating sheath of the distal end of the electric wire is placed on a front side of an upper surface of the base plate part and also a portion of the insulating sheath of the distal end of the electric wire is placed on a back side of the upper surface of the base plate part and the conductor is bonded to the base plate part by welding in that state, wherein a portion of at least the conductor of the distal end of the electric wire inserted into the electric wire connection part is covered with a metallic cover member and the conductor is bonded to the base plate part together with the cover member by welding.

(2) In the connection structure of the terminal to the electric wire with the configuration of the above (1), the cover member is constructed as substantially a rectangular parallelepiped block in which a front end wall with which a top surface of a conductor of the distal end of the electric wire is covered is left and an electric wire insertion groove is formed from a back end wall.

(3) In the connection structure of the terminal to the electric wire with the configuration of the above (1) or (2), a range from a top surface of the conductor to a portion of the insulating sheath of the distal end of the electric wire is covered with the cover member.

(4) In the connection structure of the terminal to the electric wire with the configuration of any one of the above (1) to (3), the cover member is formed of the same material as a material of the terminal.

According to the connection structure of the terminal to the electric wire with the configuration of the above (1), together with the metallic cover member formed so as to cover the portion of at least the conductor, the conductor is bonded to the base plate part of the terminal by welding, so that all the exposed portion of the conductor can be covered with the cover member and even if water adheres to the electric wire connection part, the water can be inhibited from entering the conductor by the cover member. Therefore, corrosion of the conductor due to adhesion of the water can be prevented and reliability of connection between the terminal and the electric wire can be maintained over a long period of time.

According to the connection structure of the terminal to the electric wire with the configuration of the above (2), the cover member is constructed as substantially the rectangular parallelepiped block in which the front end wall with which the top surface of the conductor of the distal end of the electric wire is covered is left and the electric wire insertion groove is formed from the back end wall, so that the distal end of the electric wire can be covered with the cover member after the distal end of the electric wire is set in the electric wire connection part, and the distal end of the electric wire can also be inserted into the tunnel-shaped electric wire insertion groove of the rectangular parallelepiped block after the cover member is previously set in the electric wire connection part. When the cover member is previously set, the front end wall of the cover member performs a function of a stopper wall, so that an insertion position of the conductor can be set properly.

According to the connection structure of the terminal to the electric wire with the configuration of the above (3), together with the conductor, a part of the insulating sheath is covered with the cover member, so that the conductor can fully be covered and corrosion of the conductor can be prevented more surely.

According to the connection structure of the terminal to the electric wire with the configuration of the above (4), the cover member is formed of the same material as the material of the terminal, so that the terminal can be connected to the electric wire more surely.

Advantage of the Invention

According to the invention, even when water adheres to the part of connection between the terminal and the electric wire, the water can be prevented from entering the conductor of the electric wire to prevent a problem of corrosion of the conductor of the electric wire, with the result that fear of damaging electrical connection reliability can be solved.

The invention has been described above briefly. Further, the details of the invention will become more apparent by reading through a mode for carrying out the invention described below with reference to the accompanying drawings.

MODE FOR CARRYING OUT THE INVENTION

An embodiment of the invention will hereinafter be described with reference to the drawings.

In addition, in the invention, the side connected to the other terminal etc. in a terminal is set at the front, and the side connected to an electric wire in the terminal is set at the back.

Figure 1:
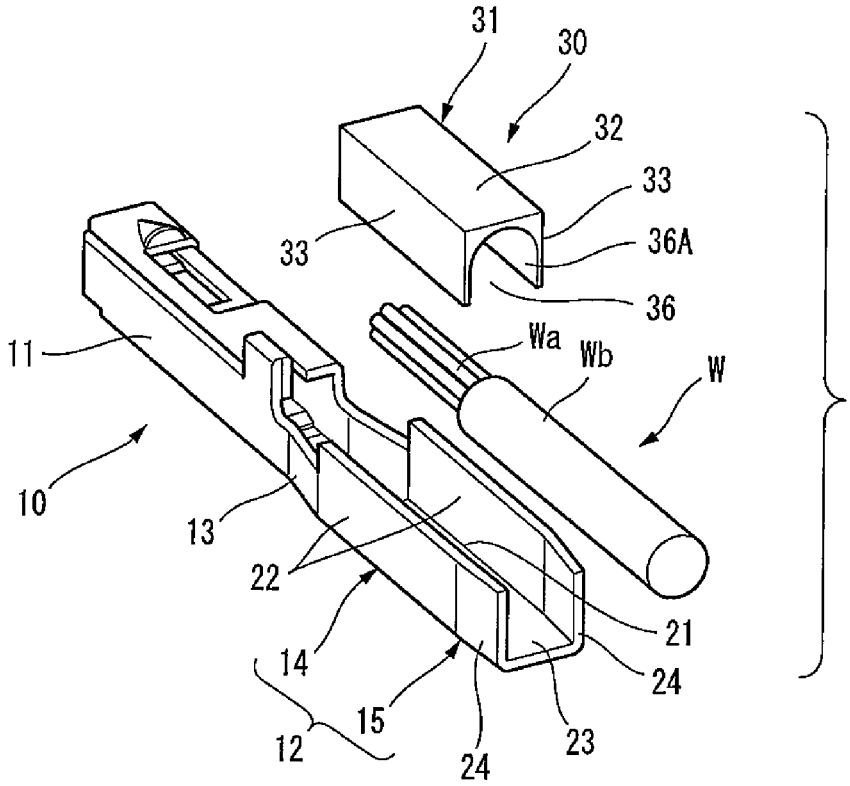
FIG. 1 is an exploded perspective view of a connection structure of a terminal to an electric wire of an embodiment of the invention.
Figure 2:
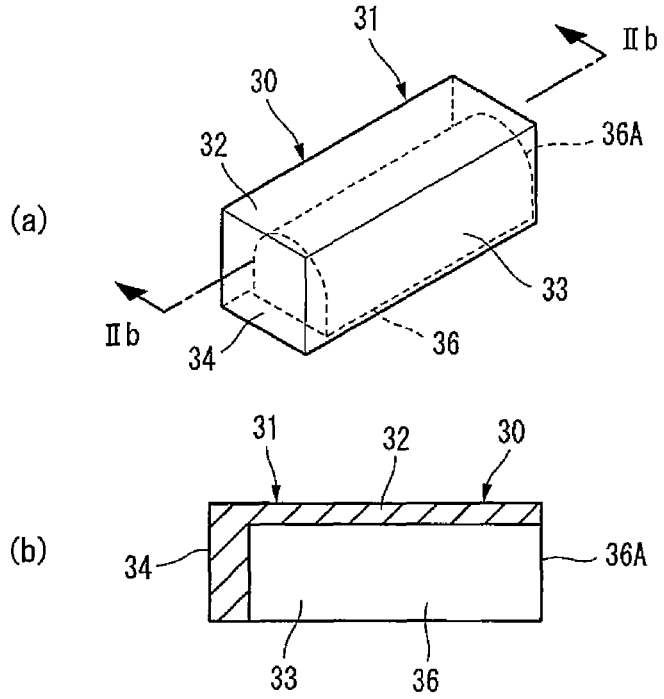
FIGS. 2(*a*) and 2(*b*) are configuration diagrams of a cover member used in the same connection structure, and FIG. 2(*a*) is a perspective view, and FIG. 2(*b*) is a sectional view taken on arrow IIb-IIb of FIG. 2(*a*).
Figure 3:
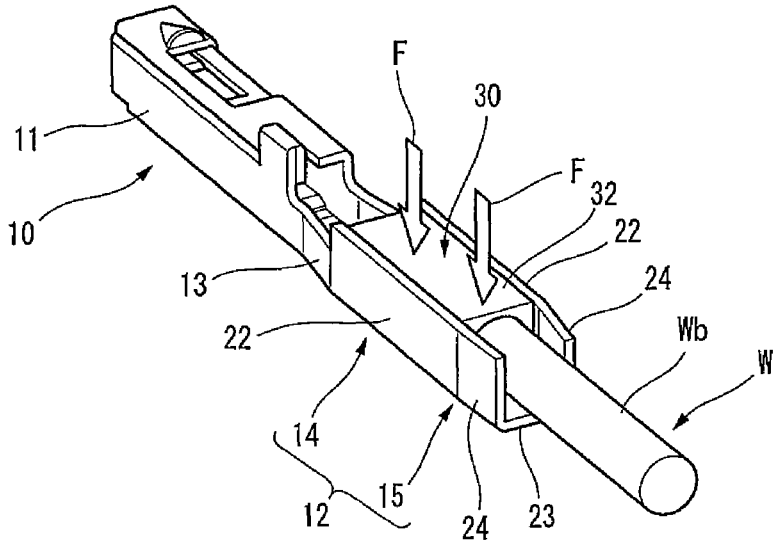
FIG. 3 is a perspective view showing a state in which the same cover member and the distal end of the electric wire are set in an electric wire connection part of the terminal.
Figure 4:
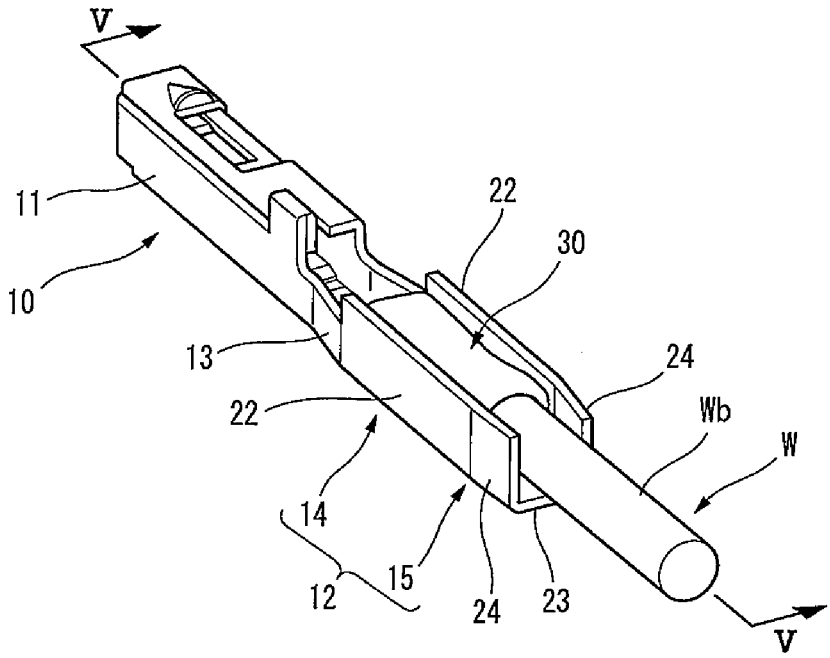
FIG. 4 is a perspective view showing a state in which the connection structure is completed by bonding the cover member and a conductor of the electric wire to a base plate part of the terminal by ultrasonic welding after setting as shown in FIG. 3.
Figure 5:
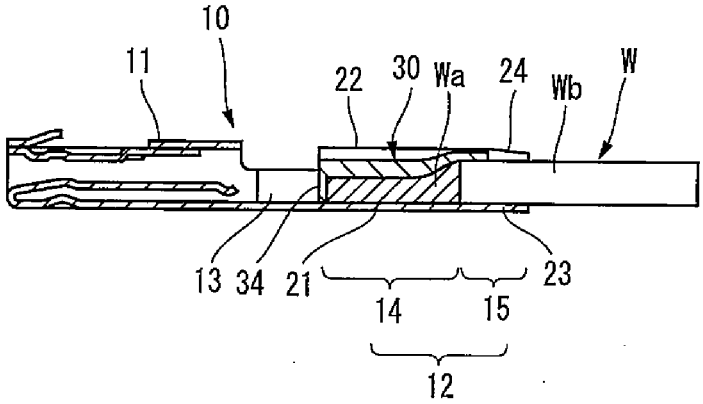
FIG. 5 is a sectional view taken on arrow V-V of FIG. 4.
Figure 6:
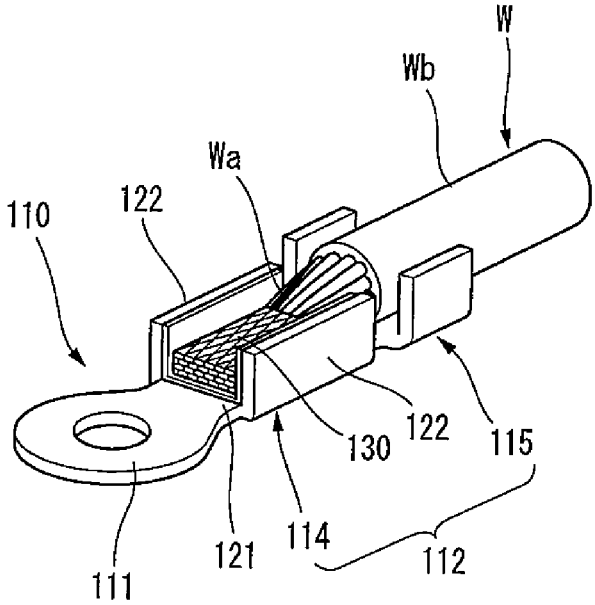
FIG. 6 is a perspective view showing one example of a conventional connection structure between a terminal and an electric wire.

FIG. 1 is an exploded perspective view of a connection structure of a terminal to an electric wire of the embodiment, and FIGS. 2(*a*) and 2(*b*) are configuration diagrams of a cover member used in the same connection structure, and FIG. 2(*a*) is a perspective view, and FIG. 2(*b*) is a sectional view taken on arrow IIb-IIb of FIG. 2(*a*). FIG. 3 is a perspective view showing a state in which the same cover member and the distal end of the electric wire are set in an electric wire connection part of the terminal, and FIG. 4 is a perspective view showing a state in which the connection structure is completed by bonding the cover member and a conductor of the electric wire to a base plate part of the terminal by ultrasonic welding after setting, and FIG. 5 is a sectional view taken on arrow V-V of FIG. 4.

As shown in FIG. 1, this terminal 10 is a female terminal, and has a box-shaped electrical connection part 11, with a built-in spring piece, for making connection to the other terminal etc. (not shown) in the front, and has an electric wire connection part 12 connected to the distal end of an electric wire W through a joining part 13 in the back of the electrical connection part 11.

The electric wire connection part 12 includes a conductor welding part 14 positioned in the front side, and a sheath holding part 15 positioned in the back side of the conductor welding part 14. The conductor welding part 14 is formed in substantially a U shape in cross-section view by having a flat base plate part 21 and a pair of mutually substantially parallel side wall parts 22 upwardly extending from both lateral edges of the base plate part 21, and the sheath holding part 15 is formed in substantially a U shape in cross-section view by having a flat base plate part 23 and a pair of mutually substantially parallel side wall parts 24 upwardly extending from both lateral edges of the base plate part 23. The base plate parts 21, 23 and the side wall parts 22, 24 ranging from the conductor welding part 14 to the sheath holding part 15 are respectively formed as continuous plate-shaped walls, but the back ends of the side wall parts 24 constructing the sheath holding part 15 may be bent inwardly to some extent in order to increase the holding strength for the electric wire W.

In the case of obtaining a connection structure of the embodiment, as shown in FIGS. 1 to 3, the distal end of the electric wire W is first placed on the electric wire connection part 12 of the terminal 10 so that a conductor Wa exposed by removing an insulating sheath Wb of the distal end of the electric wire W is positioned on an upper surface of the base plate part 21 of the conductor welding part 14 and also the portion covered with the insulating sheath Wb of the distal end of the electric wire W is positioned on an upper surface of the base plate part 23 of the sheath holding part 15. Here, before or after the distal end of the electric wire W is inserted into the electric wire connection part 12, a metallic cover member 30 with the size capable of covering both side surfaces from an upper surface of the length range from a top surface of at least the conductor Wa to the portion having the insulating sheath Wb in the distal end of the electric wire W is set in the electric wire connection part 12.

The cover member 30 in this case is made of copper which is the same as a material of the terminal 10, and is constructed as substantially a rectangular parallelepiped block 31 in which a front end wall 34 with which the top surface of the conductor Wa of the distal end of the electric wire W is covered is left and an electric wire insertion groove 36 is formed from a back end wall. That is, this rectangular parallelepiped block 31 has an upper wall 32, both side walls 33, the front end wall 34 and the tunnel-shaped electric wire insertion groove 36, and is formed in the shape in which a lower surface is opened and an inlet 36A of the electric wire insertion groove 36 is opened in the back end wall as shown in FIGS. 2(*a*) and 2(*b*). Also, the cover member 30 is constructed in width substantially equal to or slightly shorter than that of the base plate parts 21, 23 of the electric wire connection part 12, and can be fitted between the side wall parts 22, 24 of the electric wire connection part 12.

As shown in FIG. 3, in a state in which the distal end of the electric wire W set in the electric wire connection part 12 of the terminal 10 is covered with this cover member 30, for example, the portion having the insulating sheath Wb of the electric wire W is fixed to the side wall parts 24 of the sheath holding part 15 of the terminal 10, and the base plate part 21 of the conductor welding part 14 of the electric wire connection part 12 is placed on an anvil of an ultrasonic connection apparatus, and an end face of a horn chip (not shown) is pressed on the upper wall 32 of the cover member 30 while applying a force as shown by arrow F, and ultrasonic vibration is applied from the horn chip. Consequently, by the ultrasonic vibration and pressing of the horn chip, the cover member 30 and the conductor Wa are plastically deformed and the conductor Wa and the base plate part 21 are ultrasonically welded together with the cover member 30 and a bonding structure is completed as shown in FIGS. 4 and 5.

According to the connection structure configured thus, together with the metallic cover member 30 formed so as to cover the range from the conductor Wa to the portion having the insulating sheath Wb, the conductor Wa is bonded to the base plate part 22 of the terminal 10 by welding, so that all the exposed portion of the conductor Wa can be covered with the cover member 30 and even if water adheres to the electric wire connection part 12, the water can be inhibited from entering the conductor Wa by the cover member 30. Therefore, corrosion of the conductor Wa due to adhesion of the water can be prevented and reliability of connection between the terminal 10 and the electric wire W can be maintained over a long period of time.

Also, the cover member 30 is made of copper which is the same as a material of the terminal 10, and is constructed by the rectangular parallelepiped block 31 fitted between the side wall parts 22 of the electric wire connection part 12, the block 31 in which the front end wall 34 with which the top surface of the conductor Wa of the distal end of the electric wire W is covered is left and the tunnel-shaped electric wire insertion groove 36 is formed from the back end wall, so that the distal end of the electric wire W can be covered with the cover member 30 after the distal end of the electric wire W is set in the electric wire connection part 12, and the distal end of the electric wire W can also be inserted into the tunnel-shaped electric wire insertion groove 36 of the rectangular parallelepiped block 31 after the cover member 30 is previously set in the electric wire connection part 12. When the cover member is previously set, the front end wall 34 of the cover member 30 performs a function of a stopper wall, so that an insertion position of the conductor Wa can also be set properly.

In addition, the invention is not limited to the embodiment described above, and modifications, improvements, etc. can be made properly. Moreover, as long as the invention can be achieved, the number of components, materials, shapes, dimensions, arrangement places, etc. of each component in the embodiment described above are arbitrary and are not limited.

The invention has been described in detail with reference to the specific embodiment, but it is apparent to those skilled in the art that various changes or modifications can be made without departing from the spirit and scope of the invention. The present application is based on Japanese patent application (patent application No. 2010-066854) filed on Mar. 23, 2010, and the contents of the patent application are hereby incorporated by reference.

DESCRIPTION OF REFERENCE NUMERALS AND SIGNS

W ELECTRIC WIRE
Wa CONDUCTOR
Wb INSULATING SHEATH
10 TERMINAL
12 ELECTRIC WIRE CONNECTION PART
14 CONDUCTOR WELDING PART
15 SHEATH HOLDING PART
21 BASE PLATE PART
22 SIDE WALL PART
23 BASE PLATE PART
24 SIDE WALL PART
30 COVER MEMBER
34 FRONT END WALL
36 ELECTRIC WIRE INSERTION GROOVE

The invention claimed is:

1. A connection structure of a terminal to an electric wire, the terminal comprising:

an electrical connection part for making connection to the other terminal in the front of the terminal; and an electric wire connection part formed in substantially a U shape in cross-section view and having a base plate part and a pair of side wall parts upwardly extending from both lateral edges of the base plate part in a back of the electrical connection part;

wherein a distal end of an electric wire is inserted into the electric wire connection part of the terminal and a conductor exposed by removing an insulating sheath of the distal end of the electric wire is placed on a front side of an upper surface of the base plate part;

a portion of the insulating sheath of the distal end of the electric wire is placed on a back side of the upper surface of the base plate part and the conductor is bonded to the base plate part by welding in that state; and a portion of at least the conductor of the distal end of the electric wire inserted into the electric wire connection part is covered with a metallic cover member and the conductor is bonded to the base plate part together with the cover member by welding, and wherein the cover member is constructed as substantially a rectangular parallelepiped block in which a front end wall with which a top surface of a conductor of the distal end of the electric wire is covered is left and an electric wire insertion groove is formed from a back end wall.

2. The connection structure of the terminal to the electric wire according to claim 1, wherein a range from a top surface of the conductor to a portion of the insulating sheath of the distal end of the electric wire is covered with the cover member.

3. The connection structure of the terminal to the electric wire according to claim 1, wherein the cover member is formed of the same material as a material of the terminal.

* * * * *